United States Patent [19]

Nagel

[11] Patent Number: 4,566,254

[45] Date of Patent: Jan. 28, 1986

[54] BIT FOR HORSES

[76] Inventor: Reimer Nagel, Schulstrasse West 16, 2228 Friedrichskoog, Fed. Rep. of Germany

[21] Appl. No.: 659,646

[22] Filed: Oct. 11, 1984

[30] Foreign Application Priority Data

Feb. 24, 1984 [DE] Fed. Rep. of Germany ... 8405615[U]
Jul. 13, 1984 [DE] Fed. Rep. of Germany ... 8420952[U]
Jul. 19, 1984 [DE] Fed. Rep. of Germany ... 8421548[U]
Sep. 21, 1984 [DE] Fed. Rep. of Germany ... 8427836[U]

[51] Int. Cl.[4] ..... B68B 1/06
[52] U.S. Cl. ..... 54/8
[58] Field of Search ..... 54/7, 8, 9

[56] References Cited

U.S. PATENT DOCUMENTS 720,689 2/1903 Hall et al. ..... 54/7
805,606 11/1905 Werk ..... 54/8
882,791 3/1908 MacNiven ..... 54/8
973,276 10/1910 Janes ..... 54/7
1,956,861 5/1934 Freysinger ..... 54/8
2,460,912 2/1949 Wagner et al. ..... 54/7

FOREIGN PATENT DOCUMENTS 1580584 12/1980 United Kingdom ..... 54/7

*Primary Examiner*—Robert P. Swiatek
*Attorney, Agent, or Firm*—Erwin S. Teltscher

[57] ABSTRACT

The bit for horses comprises a bit bar formed from a moulded article with an oval or circular cross-section and made from a resilient-elastic material having a high abrasive resistance, which conically widens from the center of the two moulded article ends provided with the through-bores for rings for fixing the reins, accompanied by the formation of a central, narrow, resilient-elastic web extending over a short section and has frontally flattened horse tongue contact surfaces, which leads to a bit bar with high abrasive resistance, adequate central mobility and which is advantageous for the horse's tongue.

8 Claims, 9 Drawing Figures

110
15
50

12
y1
110a
214
x
110
VI
VI
50
15
110b
x
215
13
y 200
110
15
214
215

BIT FOR HORSES

BACKGROUND OF THE INVENTION

The present invention relates to a bit for horses, comprising a bit bar with terminal through-bores for receiving rings or ring-like elements for fixing the reins.

Numerous different horse bit constructions are known. All these bits have in common a bit bar, which is constructed in one piece or in two pieces and in the latter case the two bit bar pieces are interconnected by means of an articulation or chain. At their outer ends they have through-bores for receiving rings, to which the reins are fixed. These bit bars are made from metallic materials, such as iron, with the advantage that on placing the bit in the horse's mouth, the latter is at body temperature, whereas the bit is a cold object, so that the initial reaction of many horses is unfavourable thereto. Thus, in the case of external temperatures below 0° C., it is necessary to warm the bit, so that it is roughly at mouth temperature. Bit bars made from rubber-coated steel or iron members or wires also have disadvantages, in that they are subject to high abrasion, which has a disadvantageous effect on the behaviour of the horse.

SUMMARY OF THE INVENTION

The present invention solves the problem of providing a bit for horses, which is pleasant for the horse's mouth and tongue, is not subject to abrasion and is always under tension when breaking in, riding or driving the horse. In addition, it aids mastication or chewing, so that even horses with sensitive mouths accept the bit, which ensures an adequate freedom for the tongue and has a high stability, despite its flexibility.

According to the invention the problem is solved by a bit of the aforementioned type, wherein the bit bar comprises a moulded article with an approximately oval or circular cross-section made from a resilient-elastic, incompressible material having a high abrasive resistance, particularly a crosslinked polyurethane elastomer, which widens conically from the centre to the two moulded article ends provided with through-bores, accompanied by the formation of a central, narrow, resilient-elastic web extending over a short portion and which on either side of the central web has flattened horse tongue contact faces extending parallel to the longitudinal axes of the through-bores and from the web to the moulded article ends, together with a smooth, slide-like surface.

The bit constructed according to the invention provides a bit bar which will be accepted by any horse which, although made in one piece, is as mobile as if it were interrupted in the centre. This bit leads to the following further advantages.

Due to the fact that the bit is made from a resilient-elastic material, particularly a crosslinked polyurethane elastomer, the allergies which otherwise occur when using steel and iron bits are avoided.

As a result of the high abrasive resistance, there is no abrasive action of the horses tongue against the bit, as is the case with rubber or rubber-coated iron bar or steel wire bits, in which abrasion takes place in much the same way as the erasing effect of an eraser.

Static charging, as normally occurs with metal bits is avoided.

The bit is pleasant for the horse's tongue and chewing is assisted. As a result of the tongue contact surfaces on the bit, good tongue contact is ensured.

Despite a certain mobility of the two lobar bit bar end portions centrally interconnected via the resilient-elastic web, the bit is kept under tension.

The bit slides well in the horse's mouth, due to the slide-like surface of the bit bar.

Good receptiveness of the bit by the horse even in the case of external or ambient temperatures below 0° C.

Despite the central mobility of the bit bar, the latter is very durable.

According to a further advantageous embodiment of the invention according to claim 2, the bit bar comprises an arcuately bent moulded article with an oval or circular cross-section, made from a resilient-elastic material having a good abrasive resistance and in particular a crosslinked polyurethane elastomer and is centrally provided with a torsionally stiff web worked into the moulded article extending in the longitudinal direction of the latter and maintaining the latter with its bow shape, the web length being smaller than the moulded article length, permits a bending of the ends of the moulded article towards one another and which after removing a pressure or tension acting on the moulded article ends springs back into its position maintaining the bow shape of the moulded article.

Apart from the aforementioned advantages, a bit bar constructed in this way has the further advantage that no twisting or turning of the bit bar is possible when a differing tension is exerted on the bit. The bit bar is preferably used in connection with a bridle or curb bit. On tightening the resins, a lever action is exerted on the rod-like elements or bow-shaped elements holding the bit bar, as is the case e.g. with a Pelham bit, so that the rider exerts better tension via the reins. As a result of the torsionally stiff web in the moulded article forming the bit bar and which can only be bent in one direction, it is ensured that on tightening the reins the two free ends of the bit bar are moved towards one another, so that the bit bar is bent somewhat further out of its slightly prebent basic position, but on slackening tension on the reins the bit bar springs back into its initial position, i.e. the basic position as a result of the special material selection and the resilient-elastic web. There is also no twisting or turning of the bit bar in the case of a non-uniform tightening of the reins, because the web embedded in the bit bar moulded article comprises a torsionally stiff shaped member.

In addition, according to claim 3, the invention relates to a bit bar made from a rod-like moulded article with an oval or circular cross-section and formed from a resilient-elastic material having a high abrasive resistance, particularly a crosslinked polyurethane elastomer, whose moulded article has in its central region a portion bent upwards in arcuate manner running parallel to the longitudinal axes of the through-bores provided in the moulded article ends. This construction of the bit bar has the special advantage that it can be used in the case of a curb bit and simultaneously it is advantageous with respect to the horse's tongue.

This bit bar has a certain instability, i.e. flexibility, despite adequate stability, so that even in the case of a non-uniform tightening of the reins, twisting or turning of the bit bar is prevented.

Further adantageous developments of the invention can be gathered from the subclaims.

BRIEF DESCRIPTION OF THE DRAWINGS

The invention is described in greater detail hereinafter relative to the drawings, wherein show.

DETAILED DESCRIPTION OF THE INVENTION

Figure 1:
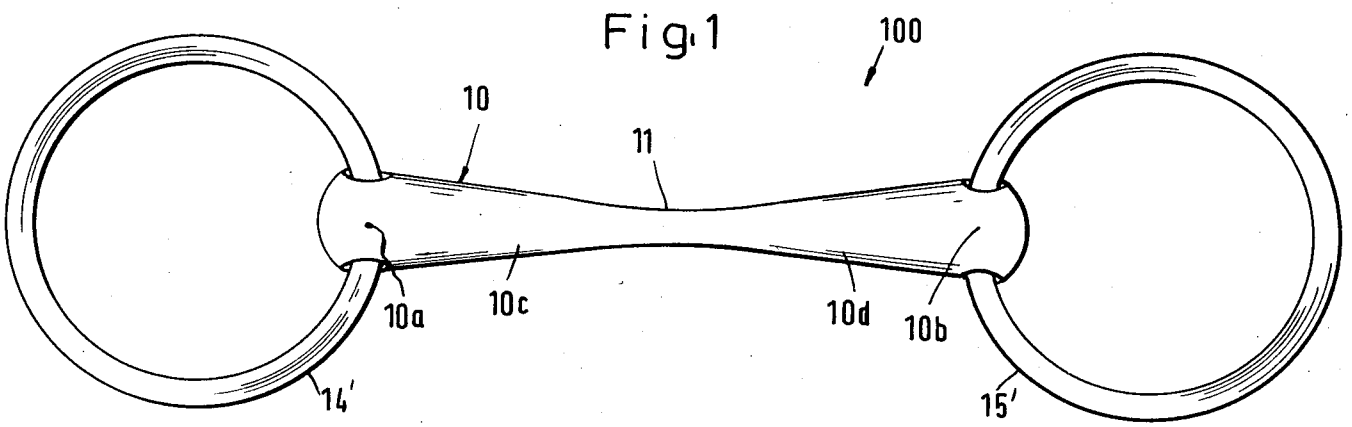
FIG. 1 a view of the bit bar.
Figure 2:
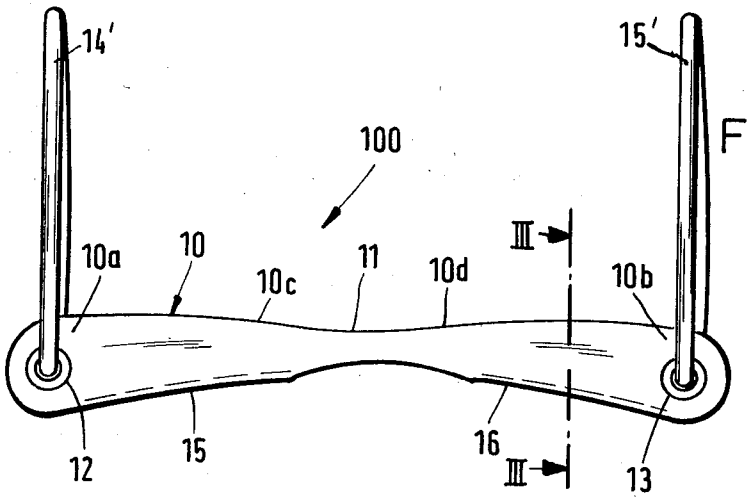
FIG. 2 a front view of the bit bar.

Bit 100 comprises according to FIGS. 1 and 2 a bit bar, which is constructed as a moulded article 10. The latter has two lobar portions 10*c*, 10*d*, widening conically towards its ends 10*a*, 10*b* and which are resiliently-elastically interconnected by means of a central narrow, short web 11. The diameter of web 11 is somewhat smaller than the diameter in the vicinity of ends 10*a*, 10*b* of moulded article 10.

Through-bores 12, 13 are provided in the moulded article ends 10*a*, 10*b* and through these are passed rings 14', 15' or ring-like elements for the connection of reins (not shown in the drawings), and which are made from a corrosion-resistant material, such as chromium steel or the like.

Figure 3:
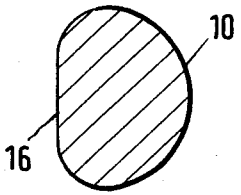
FIG. 3 a larger-scale section along line III—III of FIG. 2.

The moulded article 10 has an approximately oval or circular cross-section and in the front horse tongue contact area on either side of the central web 11 has horse tongue contact surfaces 15, 16, which extend from web 11 to the moulded article ends 10*a*, 10*b* and which are parallel to the longitudinal axes passing through through-bores 12, 13, whilst being worked from the material of moulded article 10 in the form of superficial flattened portions, so that the moulded article 10 has planar surfaces in the manner shown in FIG. 3, which ensures advantageous properties with respect to the horse's tongue.

The moulded article 10 is made from an abrasion-resistant plastic and particularly a rubber-elastic plastic, such as e.g. a crosslinked polyurethane elastomer, known under the tradename Vulkollan and which is surprisingly particularly suitable for producing the bit bar, in order to achieve the indicated advantages. Thus, due to the rubber-elasticity of web 11 of moulded article 10 it is resilient-elastic and also has a recovery capacity, so that in the case of slight bending down of the bit bar ends 10*a*, 10*b* towards one another they can be automatically returned to the stretched position whereas there is only a slight bending aside on tightening the reins. It must be particularly stressed that these plastics lead to an extremely high uniformity or regularity of the surface of moulded article 10, which then has the slidelike properties. It is possible to use all plastics with heat-imparting or radiating characteristics. The horse tongue contact surfaces 15, 16 also serve to protect the tongue.

Moulded article 10 can also be made from an abrasion-resistant plastic and specifically from an incompressible plastic, such as e.g. silicone rubber which, despite its incompressibility has a certain elasticity, so that web 11 of moulded article 10 is resilient-elastic and also has a recovery capacity. As a result on slightly bending the bit bar ends 10*a*, 10*b* towards one another, they can be returned into the stretched position, whereas there is only a slight bending aside on tightening the reins. Incompressibility is understood to mean that property of plastic where, on exerting a pressure on the plastic, the pressed-in portion returns to its initial position again after removing the pressure without showing any rebound elasticity, as is the case with normal rubbers. The same characteristics are also obtained when using polyurethane-based plastics and polyurethane can have a higher strength than other plastics.

Figure 4:
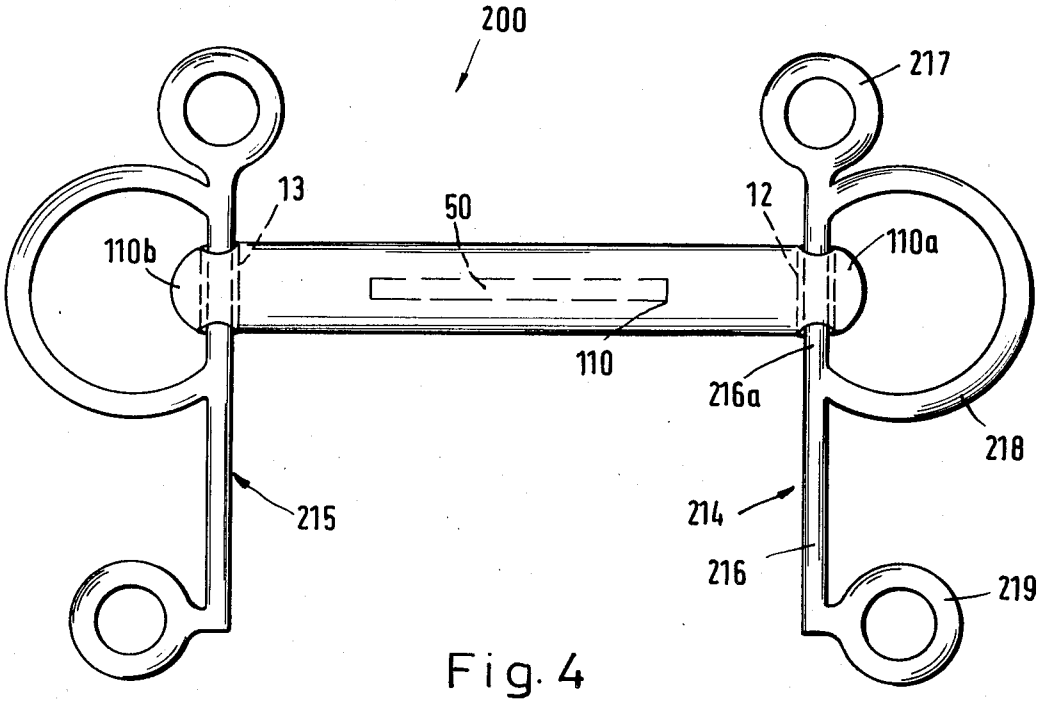
FIG. 4 a view of a bit with another bit bar embodiment.
Figures 5, 6, 7:
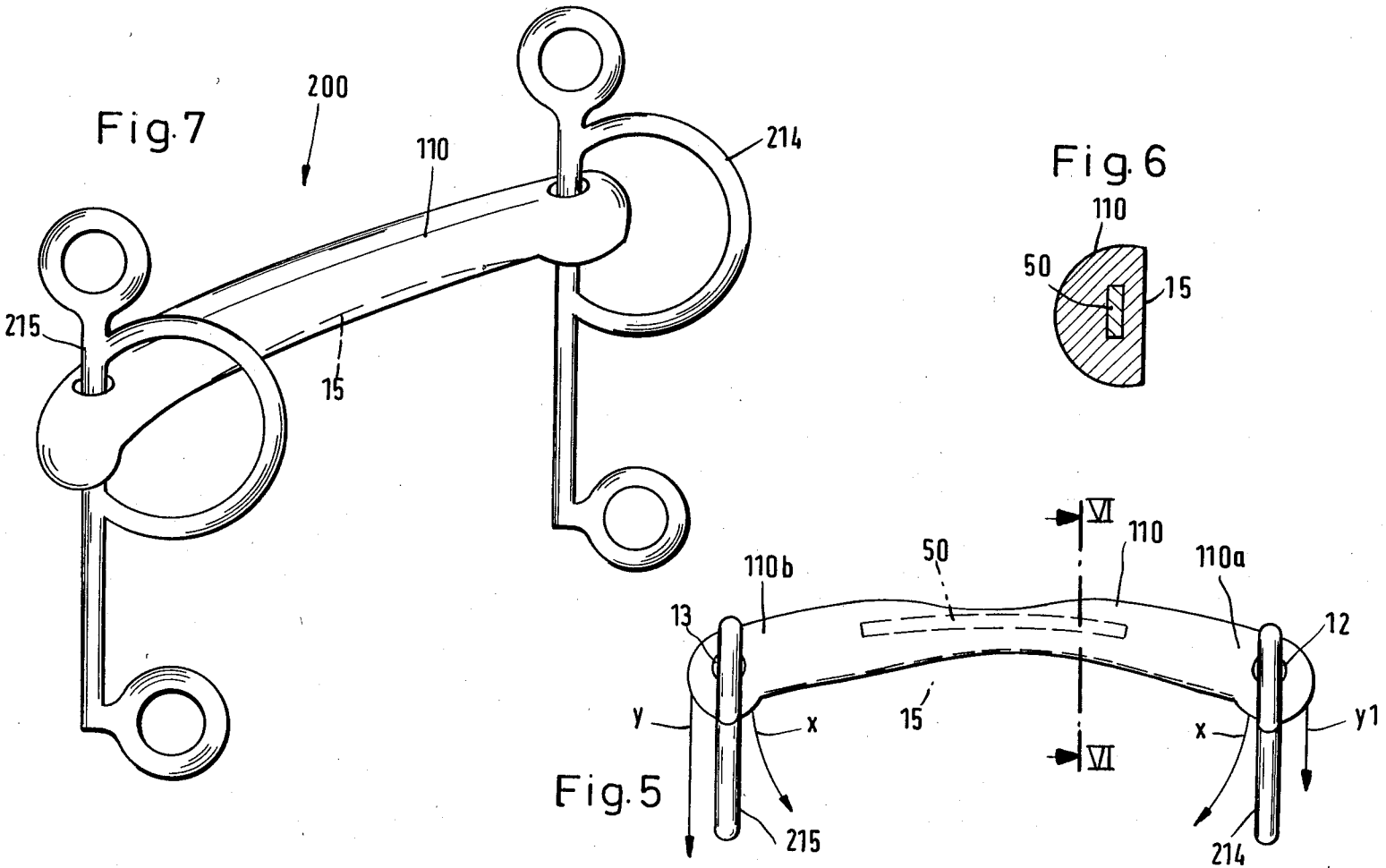
FIG. 5 a top view of the bit of FIG. 4.
FIG. 6 a larger-scale section along line VI—VI of FIG. 5.
FIG. 7 a diagrammatic view of the bit bar.

The bit shown in FIGS. 4 and 5 and designated by reference numeral 200 also comprises a bit bar constituted by moulded article 110, which is also provided with through-bores 12, 13 at its ends 110*a*, 110*b*, through which can be passed the bow-shaped elements 214, 215. The latter are used for connecting the reins and to the halter curb bit cheek strap (not shown in the drawing) and made from corrosion-resistant materials, such as chromium steel or the like.

Moulded article 110 has an approximately oval or circular cross-section and has a through flattened portion 15 in the front horse tongue contact area (FIGS. 5 and 6). Moulded article 110 is made from the same materials as moulded article 10 of the embodiment of FIG. 1.

It is particularly advantageous in connection with this bit bar that as a result of the resilient elasticity of the moulded article 110 on slightly bending the ends 110*a*, 110*b* thereof towards one another they can be automatically returned to the given basic position, but that bending can take place on tightening the reins.

As a result of the bow-shaped elements 214, 215 used, bit 200 of FIG. 4 is a curb bit, whereof the aforementioned elements are connected in per se known manner to the curb bit cheek strap of a halter. As both the bow-shaped elements 214, 215 are identically constructed, element 214 is described in greater detail hereinafter.

This bow-like element 214 comprises a bar 216, whose upper end carries a ring 217, to which is connected the curb bit cheek strap of the halter. Ring 217 is positioned at the free end of bar 216 in such a way that the imaginary extension of the bar extends through the centre of ring 217. The free lower end of the bow-like element 214 also has a ring 219, which is fixed thereto in a laterally displaced manner, i.e. towards bar 216 (FIGS. 4 and 7).

In the central area, bar 216 carries an upwardly directed half-ring 218 and the portion 216 bounded thereby is 216*a*. Portion 216*a* forms the slide and guide portion for the bit bar, i.e. for moulded article 110.

As shown in FIG. 5, moulded article 110 of bit 200 is prebent in arcuate manner and has a web 50, which is surrounded by the material of moulded article 110, i.e. is embedded in the material of the latter. Web 50 is shorter than moulded article 110. Web 50 is also prebent and in accordance with the arcuate configuration of the moulded article 110. Web 50, worked into the moulded article 110, prevents any twisting of the bit bar, if different tensile forces are exerted thereon, indicated by arrows Y, Y1 in FIG. 5.

However, moulded article 110 with its web 50 is constructed in such a way that a slight bending of the moulded article ends 110, 110*b* in the direction of arrows Y, Y1 is possible on tightening the reins. Due to the material used for the production of moulded article 110 and web 50, after the removal of the tension exerted on the bit bar, it returns to its basic position shown in FIG. 5. This springing back is aided by web 50, which is e.g. made from a prebent spring steel, which allows a bending in the direction of arrow X, but does not permit bending in the opposite direction. In addition, web 50 is constructed as a profiled member, so as to be firmly integrated with the material of shaped article 110 and in order to increase the torsional stiffness of the bit bar. Independently of web 50 arranged in moulded article 110, the latter can also have the shape and design of moulded article 10 of FIGS. 1 and 2.

Figure 8:
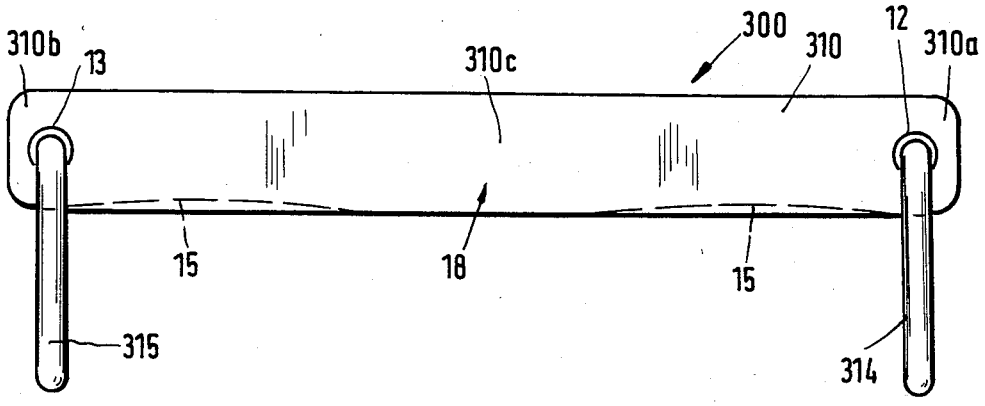
FIG. 8 is a top view of a bit with a further bit bar embodiment.
Figure 9:
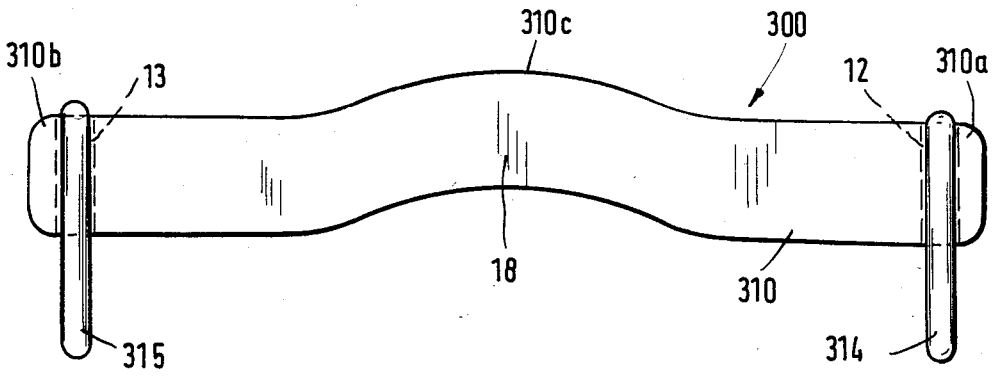
FIG. 9 a front view of the bit of FIG. 8.

The bit 300 of FIGS. 8 and 9 also has a bit bar constructed as a moulded article 310, having at its ends 310*a*, 310*b* through-bores 12, 13, through which are passed rings or bow-like elements 314, 315, which are used for connecting the reins and e.g. to the curb bit cheek strap of the halter (not shown in the drawing).

Moulded article 310 also has an approximately oval or circular cross-section. A through flattened portion 15 is provided on moulded article 310 in the front horse tongue contact area. It is also possible to provide two flattened portions 15 adjacent to the moulded article ends 310*a*, 310*b*. (FIG. 8). Flattened portion or portions 15 correspond to the flattened portion of moulded article 10.

This moulded article 310 is made from the same material as moulded article 10. It is particularly advantageous with this material selection, that the moulded article 310 is resilient-elastic and also has a recovery capacity, which ensures that in the case of a slight bending of the moulded article 310*a*, 310*b*, they are automatically returned into the given basic position, but that bending can take place on tightening the reins.

In its central area 310*c*, moulded article 310 has an upwardly arcuately bent portion 18 running parallel to the longitudinal axis of the through-bores 12, 13 provided in ends 310*a*, 310*b* of moulded article 310 (FIG. 9). As a result of this special construction, it is ensured that the tongue has adequate freedom. This moulded article 310 can have a construction corresponding to the moulded article 10, to the extent that article 310 has in its central area 310*c* a tapered web.

What is claimed is:

1. A bit for horses, having a one-piece bit bar, said bit bar comprising, in combination:

two outer portions, each having an inner end and an outer end, each of said outer portions widening from the corresponding inner end to the corresponding outer end in a lobar manner, and having a smooth, sliding face-like surface with a substantially round cross-section, each of said outer portions being made of an elastic, material means having (a) a high abrasion resistance, (b) being pressure-deformable and (c) recovering its original shape free of any rebound elasticity, each of said outer ends having a through bore adapted to accept a corrosion-resistant ring for passing reins therethrough, said outer portions being so oriented that the axes of said through bores lie in an imaginary plane, and a narrow, small diameter, resilient, elastic web connecting said inner ends to one another so that said outer portions and said web together form a one-piece bit bar, said bit bar being provided on either side of the web with flattened horse tongue contact faces parallel to said imaginary plane defined by said axes of said through bores, said web being free of flattened contact faces.

2. The bit for horses, recited in claim 1, wherein each outer portion has a substantially oval cross-section.

3. The bit for horses, as recited in claim 1, wherein each outer portion has a substantially circular cross-section.

4. The bit for horses, as recited in claim 1, wherein said material means includes plastic cross-linked polyurethane elastomer.

5. A bit for horses, having a one-piece bit bar comprising in combination:

an arcuately shaped longitudinal molded bar of a predetermined length having a through bore at each end, said bar including two outer portions, each having an inner end and an outer end, each of said outer portions widening from the corresponding inner end to the corresponding outer end in a lobar manner, and having a smooth, sliding face-like surface with a substantially round cross-section, each outer portion being adapted to receive a corrosion-resistant ring for passing reins therethrough, and having a substantially round-shaped cross-section, said bar being made of elastic material means having (a) a high abrasion resistance, (b) being pressure-deformable and (c) recovering its original shape free of any rebound elasticity;

a twist-resistant web incorporated into said molded bar extending in a longitudinal direction, and having a length smaller than said moulded bar length, whereby said ends of said molded bar can be bent towards each other by applying inwardly directed forces on said ends and, after removal of said forces, said molded bar is restored to its original arcuate shape.

6. A bit for horses as in claim 5, wherein said molded bar has a substantially round cross-section.

7. A bit for horses as in claim 5, wherein said web is made of prebent spring steel.

8. The bit for horses, as recited in claim 5, wherein said material means includes plastic cross-linked polyurethane elastomer.

* * * * *